US011535919B2

(12) United States Patent
Guiglionda et al.

(10) Patent No.: US 11,535,919 B2
(45) Date of Patent: Dec. 27, 2022

(54) METHOD OF MAKING 6XXX ALUMINIUM SHEETS

(71) Applicants: CONSTELLIUM NEUF-BRISACH, Biesheim (FR); UACJ CORP., Tokyo (JP)

(72) Inventors: Gilles Guiglionda, Seyssinet-Pariset (FR); Laurent Boissonnet, Voiron (FR); Sylvain Carisey, Fortschwihr (FR); Yusuke Yamamoto, Tokyo (JP); Yoshifumi Shinzato, Tokyo (JP); Mineo Asano, Tokyo (JP); Yoichiro Betsuki, Tokyo (JP)

(73) Assignees: CONSTELLIUM NEUF-BRISACH, Biesheim (FR); UACJ CORP., Tokyo (JP)

( * ) Notice: Subject to any disclaimer, the term of this patent is extended or adjusted under 35 U.S.C. 154(b) by 722 days.

(21) Appl. No.: 16/316,640

(22) PCT Filed: Jul. 12, 2017

(86) PCT No.: PCT/EP2017/067489
§ 371 (c)(1),
(2) Date: Jan. 10, 2019

(87) PCT Pub. No.: WO2018/011245
PCT Pub. Date: Jan. 18, 2018

(65) Prior Publication Data

US 2019/0153577 A1 May 23, 2019

(30) Foreign Application Priority Data

Jul. 14, 2016 (JP) ..... JP2016-139812
Feb. 14, 2017 (JP) ..... JP2017-025445

(51) Int. Cl.
*C22F 1/05* (2006.01)
*C22C 21/02* (2006.01)
(Continued)

(52) U.S. Cl.
CPC ..... *C22F 1/05* (2013.01); *B21B 3/00* (2013.01); *C22C 21/02* (2013.01); *C22C 21/08* (2013.01);
(Continued)

(58) Field of Classification Search
CPC .. C22F 1/05; C22F 1/057; C22F 1/043; C22F 1/047; B21B 3/00; B21B 2003/001;
(Continued)

(56) References Cited

U.S. PATENT DOCUMENTS 5,112,412 A * 5/1992 Plata ..... C22F 1/05 148/688
2002/0174923 A1 11/2002 Taguchi et al.
(Continued)

FOREIGN PATENT DOCUMENTS

CA 2712356 A1 † 10/2002
CN 102732759 A 10/2012
(Continued)

OTHER PUBLICATIONS

Jeniski, Richard A., et al., "The Effect of Iron and Manganese on the Recrystallization Behavior of Hot-Rolled and Solution-Heat-Treated Aluminum Alloy 6013," Physical Metallurgy and Materials Science, vol. 27A, No. 1, Jan. 1996, pp. 19-27, XP000551792.
(Continued)

*Primary Examiner* — John A Hevey
(74) *Attorney, Agent, or Firm* — McBee Moore & Vanik IP, LLC; Susan McBee; David Vanik

(57) ABSTRACT

The invention concerns a method for producing a 6xxx series aluminium sheet comprising the steps of homogeniz-
(Continued)

ing an ingot made from a 6XXX series aluminum alloy; cooling the homogenized ingot with a cooling rate in a range of from 150° C./h to 2000° C./h directly to the hot rolling starting temperature; hot rolling the ingot to a hot rolling final thickness and coiling at the hot rolling final thickness with such conditions that at least 50% recrystallization is obtained; cold rolling to obtain a cold rolled sheet. The method of the invention is particularly helpful to make sheets for the automotive industry which combine high tensile yield strength and good formability properties suitable for cold stamping operations, as well as high surface quality and high corrosion resistance with a high productivity.

19 Claims, 3 Drawing Sheets

(51) Int. Cl.

| | |
|---|---|
| ***C22C 21/08*** | (2006.01) |
| ***B21B 3/00*** | (2006.01) |
| ***C22C 21/14*** | (2006.01) |
| ***C22C 21/16*** | (2006.01) |
| ***C22C 21/18*** | (2006.01) |
| ***C22F 1/057*** | (2006.01) |

(52) U.S. Cl.
CPC ..... *C22C 21/14* (2013.01); *C22C 21/16* (2013.01); *C22C 21/18* (2013.01); *C22F 1/057* (2013.01); *B21B 2003/001* (2013.01)

(58) Field of Classification Search
CPC ..... B21B 1/36; B21B 37/74; C22C 21/14; C22C 21/16; C22C 21/18; C22C 21/08; C22C 21/02
See application file for complete search history.

(56) References Cited

U.S. PATENT DOCUMENTS

| | | | | |
|---|---|---|---|---|
| 2004/0094249 | A1* | 5/2004 | Uchida | C22C 21/08 148/693 |
| 2008/0178968 | A1* | 7/2008 | Uchida | C22F 1/043 148/439 |
| 2016/0047021 | A1* | 2/2016 | Nakamura | C22C 21/02 420/532 |
| 2017/0349989 | A1* | 12/2017 | Gupta | C22F 1/05 |
| 2019/0119800 | A1* | 4/2019 | Yamamoto | C22C 21/18 |
| 2020/0340091 | A1* | 10/2020 | Boissonnet | B21B 3/00 |

FOREIGN PATENT DOCUMENTS

| | | | |
|---|---|---|---|
| CN | 103789583 | A | 5/2014 |
| EP | 0786535 | A1 | 7/1997 |
| EP | 1375691 | A1 | 1/2004 |
| JP | H059674 | A | 1/1993 |
| JP | 2008274319 | A † | 11/2008 |
| JP | 2010242215 | A | 10/2010 |
| WO | 0052219 | A1 † | 9/2000 |
| WO | 0250329 | A1 † | 6/2002 |
| WO | 2016/012691 | A1 | 1/2016 |

OTHER PUBLICATIONS

Wang, Xiaofeng, et al., "The dependence of microstructure, texture evolution and mechanical properties of Al—Mg—Si—Cu alloy sheet on final cold rolling deformation." Journal of Alloys and Compounds, 657, 2016, pp. 906-916, XP29332218.

International Search Report received from corresponding PCT/EP2017/067489, dated Aug. 30, 2017.

Aluminium Association, "Rolling Aluminum: From the Mine Through the Mill", third edition, "DC Ingot Casting", section 3-6 (DC ingot casting), section 4-6 (Hot or Cold Rolling), section 5-4 (Sheet Hot Rolling: The Single Stand Reversing Mill), section 6-3 (Artificial Aging) and Appendix B 10B-3 (4.2.2 Subdivision of T Temper: Thermally Treated), publication date Dec. 2007.†

* cited by examiner
† cited by third party

METHOD OF MAKING 6XXX ALUMINIUM SHEETS

CROSS REFERENCE TO RELATED APPLICATIONS

This application is a National Stage entry of International Application No. PCT/EP2017/067489 filed 12 Jul. 2017, which claims priority to Japan Patent Application No. 2016-139812, filed 14 Jul. 2016 and Japan Patent Application No. 2017-025445, filed 14 Feb. 2017.

BACKGROUND

The claimed invention was made as a result of activities undertaken within the scope of a joint research agreement between UACJ Corporation, Constellium Neuf-Brisach and C-TEC Constellium technology center

Field of the Invention

The present invention relates to a method of making 6XXX series aluminium sheet, particularly useful for the automotive industry.

Description of Related Art

Various aluminium alloys are used in the form of sheets or blanks for automotive usages. Among these alloys, AA6xxx aluminium alloys series, such as AA6016-T4 are known to combine interesting chemical and mechanical properties such as hardness, strength, and even corrosion resistance. In addition to the requirements discussed above, another requirement is that the aluminum alloys for automotive components do not have objectionable and/or deleterious surface defects referred to as roping, or paint brush lines, which appear on the surface of stamped or formed aluminum sheet components. The roping lines appear in the rolling direction only upon application of sufficient transverse strain, such as that occurring in typical stamping or forming operations. These properties generally make AA6xxx aluminium alloys a material of choice in the automotive industry. In order to face the constant increase of applications of these sheets in the automotive industry, it is needed to improve the speed of the method of making such products. Indeed, the current method includes several heat treatments, rolling and cooling operations in order to accommodate to the minimum requirements to obtain the targeted performance values.

The U.S. Pat. No. 6,652,678 describes a method of converting an ingot of a 6000 series aluminium alloy to self-annealing sheet, comprising subjecting the ingot to a two-stage homogenisation treatment, first at least 560° C. and then at 450° C. to 480° C., then hot rolling the homogenised ingot at a starting hot roll temperature of 450° C. to 480° C. and a finishing hot roll temperature of 320° C. to 360° C. The resulting hot rolled sheet has an unusually low Cube recrystallization component.

The patent application US2016/0201158 describes a method of producing a 6xxx series aluminium sheet, comprising: casting a 6xxx series aluminium alloy to form an ingot; homogenizing the ingot; hot rolling the ingot to produce a hot rolled intermediate product, followed by: a) after exit temperature coiling, immediately placing into an anneal furnace, or b) after exit temperature coiling, cooling to room temperature and then placing into an anneal furnace; annealing; cold rolling; and subjecting the sheet to a continuous anneal and solution heat treatment process. The application details the problems related to the self-annealing method.

The patent application EP1375691 A9 describes a method for producing a rolled sheet of a 6000 type aluminium alloy containing Si and Mg as main alloy components, which comprises subjecting an ingot to a homogenization treatment, cooling to a temperature lower than 350° C. at a cooling rate of 100° C./hr or more, optionally to room temperature, heating again to a temperature of 300 to 500° C. and subjecting it to hot rolling, cold rolling the hot rolled product, and subjecting the cold rolled sheet to a solution treatment at a temperature of 400° C. or higher, followed by quenching.

The patent application EP0786535 A1 describes a method wherein an aluminum alloy ingot containing not less than 0.4% by weight and less than 1.7% by weight of Si, not less than 0.2% by weight and less than 1.2% by weight of Mg, and Al and unavoidable impurities for the remainder is homogenized at a temperature of not lower than 500° C.; the resultant product being cooled from a temperature of not lower than 500° C. to a temperature in the range of 350-450° C. and started to be hot rolled; the hot rolling step being finished at a temperature in the range of 200-300° C.; the resultant product being subjected to cold rolling at a reduction ratio of not less than 50% immediately before it has been solution-treated; the cold rolled product being then solution-treated in which it is retained at a temperature in the range of 500-580° C. at a temperature increasing rate of not less than 2° C./s for not more than 10 minutes; the resultant product being subjected to hardening in which it is cooled to a temperature of not higher than 100° C. at a cooling rate of not less than 5° C./s.

Regarding the formability of aluminum alloy sheets, it has been indicated that it is related to the size of particles such as Al—Fe—Si, Mg—Si particles, etc., that constitute precipitates in the alloy as well as to the texture of the alloy. For example, patent applications JP 2012-77319, JP 2006-241548, JP 2004-10982, JP 2003-226926 propose methods that take into perspective the control of the size and distribution of those particles, control of the texture and the resulting r value.

On another hand, in parallel with the proposals relating to formability improvement such as described above, several initiatives aiming at improving roping resistance in relation with appearance quality after forming have also been reported. According to these, the occurrence of roping is related to the recrystallization behavior of the material. And as a measure to restrain the occurrence of roping, it has been proposed to control recrystallization at the stage of sheet production by means of the hot rolling or the like that is carried out after homogenization of the alloy ingot. As practical measures of such roping resistance improvement, the patents JP2823797 and JP3590685 restrain the crystal grain from coarsening during hot rolling by chiefly setting the starting temperature of hot rolling to a relatively low temperature of 450° C. or less, and seek to control the material structure after the subsequent cold working and solution treatment. Patent application JP2009-263781 recites implementing different circumferential speed rolling in warm areas and different circumferential speed rolling in the cold areas after hot rolling. Here, patent JP3590685, and patent applications JP2012-77318 and JP2010-242215 propose to perform intermediate annealing after hot rolling, or to perform intermediate annealing after briefly carrying out cold rolling.

The patent application JP2015-67857 describes a manufacturing method of Al—Mg—Si-based aluminum alloy sheet for automobile panel that is characterized by the following: an ingot is prepared that comprises Si: 0.4~1.5 wt. %, Mg: 0.2~1.2 wt. %, Cu: 0.001~1.0 wt. %, Zn: 0.5 wt. % or less, Ti: than 0.1 wt. %, B: 50 ppm or less, as well as one or more than two of the following Mn: 0.30 wt. % or less, Cr: 0.20 wt. % or less, Zr: 0.15% or less, balance being Al and inevitable impurities, the said ingot goes through homogenization treatment at a temperature above 450° C., it is cooled to less than 350° C. at a cooling rate of over 100° C./hour, and is once again reheated at a temperature between 380° C.~500° C., and hot rolling is conducted to initiate the rolling process, and plate with thickness of 4~20 mm is created, and the said plate goes through cold reduction so that its plate thickness reduction rate is over 20% and the plate thickness is greater than 2 mm, and goes through intermediate annealing at a temperature between 350~580° C., and goes through further cold reduction, and then after it goes through a solution treatment at a temperature range of 450~600° C., it is rapidly cooled to a temperature that is less than 150° C. at an average cooling speed of over 100° C./minute, and is heat processed within 60 minutes after the rapid cooling process so that it stays within 40~120° C. for 10 to 500 minutes.

There is thus a need in the automotive industry for an improved method, in particular with a high productivity, of making 6xxx series aluminium alloys sheets, which combine high tensile yield strength and good formability properties suitable for cold stamping operations, as well as high surface quality and high corrosion resistance.

SUMMARY

An object of the invention is a method for producing a 6xxx series aluminium sheet comprising the steps of

- homogenizing an ingot made from a 6XXX series aluminum alloy comprising preferably 0.3-1.5 wt. % of Si, 0.3-1.5 wt. % of Mg and 1.5 wt. % or less of Cu,
- cooling the homogenized ingot with a cooling rate in a range from 150° C./h to 2000° C./h directly to the hot rolling starting temperature, wherein a thermal differential of less than 40° C. over the entire ingot cooled from the homogenization temperature is obtained when hot rolling is started,
- hot rolling the ingot to a hot rolling final thickness and coiling at the hot rolling final thickness with such conditions that at least 50% recrystallization is obtained,
- cold rolling to obtain a cold rolled sheet.

Another object of the invention is a cold rolled sheet obtained according to the method of the invention, which after solution heat treatment in a continuous annealing line operated in such a way that the equivalent holding time at 540° C., $t_{eq}^{540°}$, is less than 25 s, the equivalent holding time being calculated according to the equation $$t_{eq}^{540°} = \int_{time\ spent\ in\ furnace} dt.\exp\left[-\frac{Q}{R}\cdot\left(\frac{1}{T^{°C}(t)+273}-\frac{1}{540+273}\right)\right]$$

with Q an activation energy of 146 kJ/mol and R=8.314 J/mol,

- quenching and natural aging for at least 6 days, is such that it reaches a tensile strength of at least 85% and preferably of at least 90% of the maximum tensile strength obtained after solution heat treatment with an equivalent holding time at 540° C., $t_{eq}^{540°}$, of at least 35 sec.

DETAILED DESCRIPTION OF A PREFERRED EMBODIMENT

Figure 1:
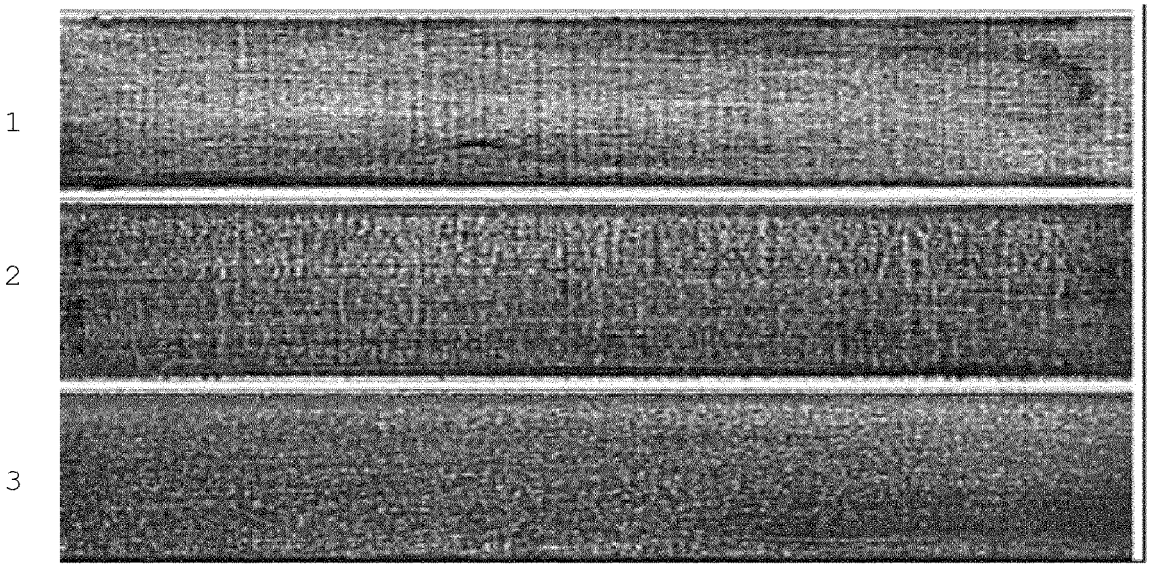
FIG. 1: example of roping samples with grades 1, 2 and 3 (1 average-3 excellent)

All aluminium alloys referred to in the following are designated using the rules and designations defined by the Aluminum Association in Registration Record Series that it publishes regularly, unless mentioned otherwise.

Metallurgical tempers referred to are designated using the European standard EN-515.

All the alloy compositions are provided in weight % (wt. %).

The inventors have found that the method of the prior art to make 6xxx aluminium alloy series can be improved without prejudice to the strength, formability properties, surface quality and corrosion resistance.

According to the invention, an ingot is prepared by casting, typically Direct-Chill casting, using 6xxx series aluminium alloys. The ingot thickness is preferably at least 250 mm, or at least 350 mm and preferentially a very thick gauge ingot with a thickness of at least 400 mm, or even at least 500 mm or 600 mm in order to improve the productivity of the process. Preferably the ingot is from 1000 to 2000 mm in width and 2000 to 8000 mm in length.

Preferably, the Si content is from 0.3 wt. % to 1.5 wt. %.

Si is an alloying element that forms the base of the alloy series of the present invention and, together with Mg and Cu, contributes to strength improvement. When the Si content is under 0.3 wt. % the aforementioned effect may be insufficient, while a content exceeding 1.5 wt. % may cause the occurrence of coarse Si particles and coarse Mg—Si base particles and leads to a drop in bending workability. The Si content is therefore preferably set within a range of 0.3-1.5 wt. %. Here, in order to reach a better balance between material strength and bending workability, the Si content should more preferably be within the range of 0.6-1.3 wt. %.

Mg is also an alloying element that forms the base of the alloy series that is the target of the present invention and, together with Si and Mg, contributes to strength improvement. Preferably, the Mg content is from 0.3 wt. % to 1.5 wt. %. When the Mg content is under 0.3% wt. %, the G.P. zone formation that contributes to strength improvement, decreases due to precipitation hardening at the time of paint baking, and strength improvement may therefore be insufficient. On the other hand, a content exceeding 1.5 wt. % causes the occurrence of coarse Mg—Si base particles and may lead to a drop in bending workability. The Mg content is therefore preferably set within a range of 0.4 wt. % to 1.5 wt. %. Here, in order to reach better material strength and bending workability of the final sheet, the Mg content should preferably be within the range of 0.4-0.8 wt. %.

While Cu is not an essential additive element, it contributes, together with Si and Mg to strength improvement, and is therefore an important optional additive element. Also Cu may affect the precipitation state and coarsening speed of Mg—Si base particles, it is an important additive element in this sense as well. While Cu is an optional additive element, when added, it has to be preferably 1.5 wt. % or less. This is because a Cu content exceeding 1.5 wt. % causes the occurrence of coarse Mg—Si—Cu base particles and leads to a drop in bending workability. The preferable amount of Cu differs according to the objective of the aluminum alloy rolled material to be produced. If importance is set on the corrosion resistance of the aluminum alloy, the Cu content should preferably be under 0.1 wt. % or can be about 0 wt. %. On the other hand, if importance is set on the formability of the aluminum alloy, it could be advantageously added in an amount of 0.3 wt. % to 1.5 wt. % so that tensile strength may be improved. Furthermore, if importance is set on a balance between corrosion resistance and formability, there are instances when the content is set to 0.1 wt. % or more and under 0.3 wt. %.

Mn and Cr are effective elements for strength improvement, crystal grain refining and structure stabilization. When the Mn content is under 0.03 wt. %, and/or the Cr content is under 0.01 wt. % respectively, the aforementioned effect maybe insufficient. On the other hand, an Mn content exceeding 0.5 wt. % and/or a Cr content exceeding 0.4 wt. % may not only cause a saturation of the above effect but also cause the generation of multiple intermetallic compounds that could have an adverse effect on formabilty, in particular hemming. Consequently, the Mn content is preferably set within a range of 0.03-0.5 wt. % and/or Cr within a range 0.01-0.4 wt. % respectively.

Fe is also an effective element for strength improvement and crystal grain refining. A Fe content under 0.03 wt. % may not produce a sufficient effect while, on the other hand, a Fe content exceeding 1.0 wt. % may cause the generation of multiple intermetallic compounds that could make bending workability drop. Consequently, the Fe content is preferably set within a range of 0.03 to 0.4 wt. %.

Grain refiners such as Ti, $TIB_2$ or the like are typically added with a total Ti content of up to 0.1 wt % and preferably between 0.01 and 0.05 wt. %.

The rest is aluminium and unavoidable impurities up to 0.05 wt. % each and 0.15 wt. % total.

Particularly preferred aluminium alloy compositions suitable for the invention are AA6005, AA6016, AA6111, AA6013 and AA6056.

In a first preferred embodiment of the invention said 6xxx series aluminium alloy comprise in wt. %, Si: 0.5-0.8; Mg: 0.3-0.8; Cu: up to 0.3; Mn: up to 0.3; Fe up to 0.5; Ti: up to 0.15, rest aluminium and unavoidable impurities up to 0.05 each and 0.15 total, and preferably Si: 0.6-0.75; Mg: 0.5-0.6; Cu: up to 0.1; Mn up to 0.1; Fe 0.1-0.25; Ti: up to 0.05, rest aluminium and unavoidable impurities up to 0.05 each and 0.15 total.

In a second preferred embodiment of the invention said 6xxx series aluminium alloy comprise in wt. %, Si: 0.7-1.3; Mg: 0.1-0.8; Cu: up to 0.3; Mn: up to 0.3; Fe up to 0.5; Ti: up to 0.15, rest aluminium and unavoidable impurities up to 0.05 each and 0.15 total, and preferably Si: 0.8-1.1; Mg: 0.2-0.6; Cu: up to 0.1; Mn up to 0.2; Fe 0.1-0.4; Ti: up to 0.05, rest aluminium and unavoidable impurities up to 0.05 each and 0.15 total.

The ingot is then homogenised typically at a temperature between 500° C. and 590° C., preferably at a temperature between 500° C. and 570° C. and more preferably between 540° C. and 560° C. typically for a period of 0.5 to 24 hours, for example during at least 4 hours and preferably during at least 8 hours. In an embodiment the homogenization is carried out at a temperature of at most 555° C. Homogenization may be carried out in one stage or several stages of increasing temperature, in order to avoid incipient melting.

After homogenization, the ingot is cooled with a cooling rate in a range from 150° C./h to 2000° C./h directly to the hot rolling starting temperature. Preferably, the cooling rate is of at least 200° C./h, preferably at least 250° C./h and preferentially at least 300° C./h. In an embodiment the cooling rate is of at most 1500° C./h, or at most 1000° C./h or at most 500° C./h. The cooling rate of the invention is preferably obtained at mid-thickness and/or at quarter thickness of the ingot and/or on average of the ingot, typically between the homogenizing temperature and the hot rolling temperature and preferably in the temperature range between 500° C. and the hot rolling temperature. A device such as the cooling facility disclosed in patent application WO2016/012691, which is enclosed by reference in its entirety, and the method described therein are suitable for cooling the ingot. Preferably, a thermal differential of less than 40° C. over the entire ingot cooled from the homogenization temperature is obtained when hot rolling is started. If a thermal differential of less than 40° C. is not obtained, the desired hot rolling starting temperatures may not be obtained locally in the ingot and the desired roping resistance and hemming properties may not be obtained. Preferably the cooling is carried out in at least two phases: a first spraying phase in which the ingot is cooled in a chamber comprising ramps of nozzles for spraying cooling liquid or spray under pressure, divided into upper and lower parts of said chamber, so as to spray the two large top and bottom surfaces of the ingot and a complementary phase of thermal equalization in still air, in a tunnel preferably with interior reflective walls, lasting from 2 to 30 minutes depending on the ingot format and the cooling value. Preferably, the spraying and thermal equalization phases are repeated in the case of very thick ingots and for an overall average cooling of more than 80° C. Preferably the cooling liquid, including that in a spray, is water, and preferably deionized water. Preferably the head and the foot of the ingot, or typically the 300 to 600 mm at the ends, are less cooled than the rest of the ingot, so as to maintain a hot head and foot, a favourable configuration for engaging the ingot during reversible hot rolling. In an embodiment the cooling of the head and foot is modulated by turning the ramps of nozzles on or off. In another embodiment the cooling of the head and foot is modulated by the presence of screens. Preferably the spraying phases and not thermal equalization are repeated, and the head and foot of the ingot, or typically the 300 to 600 mm at the ends, are cooled differently from the rest of the ingot in at least one of the spray chambers. Preferably, the longitudinal thermal uniformity of the ingot is improved by relative movement of the ingot in relation to the spray system: the ingot passes or moves with a reciprocating movement facing a fixed spray system or vice versa. Preferably the transverse thermal uniformity of the ingot is ensured by modulating spraying in the ingot width by switching the nozzles or spray nozzles on or off, or screening said spraying. Advantageously, the ingot moves horizontally in the spray chamber and its speed is greater than, or equal to 20 mm/s. The reason why the cooling speed after homogenization is regulated in such a manner is because if the cooling speed is too low, too coarse and possibly numerous Mg—Si based particles, tend to precipitate and the product may be difficult to solutionize but if the cooling speed is too high, too fine and possibly scarce Mg—Si based particles may precipitate and the product may be difficult to recrystallize at the exit of hot rolling. In the present invention, the method for obtaining the temperature at mid-thickness and/ or quarter thickness of the ingot and/or on average of the ingot may consist of using and measuring an ingot with an embedded thermoelement, or making calculation using a heat transfer model.

In an embodiment the particle size of the Mg—Si based particles may be further controlled by holding the ingot at the hot rolling starting temperature. Hence, when holding the homogenized then cooled ingot at hot rolling temperature, the size of the precipitation particles of said aluminum alloy may be controlled by holding said aluminum alloy for a period equal to or longer than a holding time calculated with following formula A:

$$\text{Holding time (h)}=\text{cooling speed}(^\circ\text{ C./h})\div 120(^\circ\text{ C.})\times \text{EXP}(-Q/RT)+\text{EXP}(-Q/RT0)\times(1-0.98\text{EXP}(-8C^2)) \quad \text{A:}$$

In the Formula A, the meaning of Q, R, T and T0 is as follows.

Q: Activation energy of Cu in aluminum (126 kJ/mol)

R: Gas constant (8.3145 J/mol·K)

T: Hot rolling temperature (K)

T0: Reference hot rolling temperature (673K)

C: Cu content (wt. %)

However in another embodiment, which is favourable to improve productivity, the cooling rate is adjusted so that the holding time at the hot rolling temperature is less than 15 mn, preferably less than 10 mn and preferentially less than 5 mn.

In the hot rolling step, the setting of the temperature for coiling after hot rolling is important. With the present invention, the aforementioned cooling after homogenization and optionally holding at hot rolling temperature enable to obtain an appropriate particle distribution, and to perform hot rolling on an ingot with particles of controlled size that do not hinder the promoting action and grain boundary migration of recrystallization and are easy to solutionize. Here, appropriately setting the coiling temperature for the obtained hot rolled sheet produces recrystallization at the hot rolling exit, and enables to obtain a recrystallized structure that forms the base of the material structure for roping resistance improvement.

Preferably the hot rolling starting temperature is between 350° C. and 450° C. In some embodiments the hot rolling starting temperature is at least 370° C., or at least 375° C. or at least 380° C., or at least 385° C., at least 390° C., or at least 395° C., or at least 400° C., or at least 405° C. In some embodiments the hot rolling starting temperature is at most 445° C., or at most 440° C. or at most 435° C., or at most 430° C., or at most 425° C., or at most 420° C., Typically it is meant by hot rolling starting temperature the temperature at mid-length and mid-thickness of the ingot. The ingot is preferably hot rolled to a hot rolling final thickness and coiled at the hot rolling final thickness with such conditions that at least 50% recrystallization is obtained at the hot rolling final thickness. Preferably, the ingot is hot rolled to a hot rolling final thickness and coiled at the hot rolling final thickness with such conditions that that at least 80% recrystallization, preferentially at least 90% and more preferentially at least 98% is obtained at the hot rolling final thickness. By at least 50%, 80%, 90% or 98% recrystallization it is meant, respectively, that the recrystallization rate measured at at least three locations through the width of the strip obtained after hot rolling has a minimum value of at least 50%, 80%, 90% or 98%. Typically, recrystallization varies through the thickness of the sheet and may be complete on the surfaces of the sheet but incomplete at mid-thickness. The preferred recrystallization rate may depend on the sheet composition. For the composition according to the first embodiment the most preferred recrystallization rate is at least 98% whereas for the composition according to the second embodiment a preferred recrystallization rate of at least 85% is usually sufficient. In order to obtain recrystallization at the hot rolling final thickness it is advantageous that the hot rolling exit temperature, also known as coiling temperature, is at least 300° C. In an embodiment the hot rolling exit temperature is at least 310° C. or at least 330° C. or at least 332° C. or at least 335° C., or at least 337° C. or at least 340° C. or at least 342° C., or at least 345° C. In an embodiment the hot rolling exit temperature is at most 380° C. The thickness reduction during the last stand of hot rolling may also affect the recrystallization rate and the final properties of the product and preferably the thickness reduction during the last stand of hot rolling is at least 25%. In an embodiment it is at least 27% or at least 30% or at least 32%. In an embodiment is at most 50% or at most 47% or at most 45% or at most 42%. The hot rolling final thickness is typically between 4 and 10 mm.

Cold rolling is realized directly after the hot rolling step to further reduce the thickness of the aluminium sheets. With the method of the invention annealing and/or solution heat treatment after hot rolling or during cold rolling is not necessary to obtain sufficient strength, formability, surface quality and corrosion resistance. Preferably no annealing and/or solution heat treatment after hot rolling or during cold rolling is carried out. The sheet directly obtained after cold rolling is referred to as the cold rolled sheet. The cold rolled sheet thickness is typically between 0.5 and 2 mm.

In an embodiment, the cold rolling reduction is at least 65% or at least 70% or at least 75% or at least 80%.

Advantageous embodiments of cold rolling reduction may enable to obtain improved hemming properties and/or to obtain an advantageous grain size for surface properties such as roping resistance.

The cold rolled sheet is particularly advantageous at least because it is easy to solutionize, while having high roping resistance and good hemming properties. The skilled person usually believes that to achieve the desired combination of strengths in the as-supplied and paint bake tempers for products for which coiling at hot rolling final thickness is done with such conditions that at least 50% recrystallization is obtained, continuous anneal solution heat treatment lines must use high solution heat treatment temperatures and long soak times. To the contrary the cold rolled sheet of the invention, after solution heat treatment in a continuous annealing line operated in such a way that the equivalent holding time at 540° C., $t_{eq}^{540^\circ}$, is less than 25 s, the equivalent holding time being calculated according to the equation $$t_{eq}^{540^\circ} = \int_{\text{time spent in furnace}} dt.\exp\left[-\frac{Q}{R}\cdot\left(\frac{1}{T^{\circ C.}(t)+273}-\frac{1}{540+273}\right)\right]$$

with Q an activation energy of 146 kJ/mol and R=8.314 J/mol, quenching and natural aging for at least 6 days, is such that it reaches a tensile yield strength of at least 85% and preferably of at least 90% of the maximum tensile yield strength obtained after solution heat treatment with an equivalent holding time at 540° C., $t_{eq}^{540^\circ}$, of at least 35 sec. Preferably the cold rolled sheet of the invention provides after solution heat treatment in a continuous annealing line operated in such a way that the equivalent holding time at 540° C., $t_{eq}^{540°}$, is less than 25 s, quenching and natural aging for at least 6 days, is such that the solution heat treated sheet has a high roping resistance of level 3 and a good hemming properties of level 1.

The cold rolled sheet of the invention can then be subjected to a solution heat treatment and quench process with a continuous annealing line. Preferably the continuous annealing line is operated in such a way that the equivalent holding time at 540° C., $t_{eq}^{540°}$, is less than 35 sec, preferably less than 30 s and preferentially less than 25 s equivalent holding time calculated according to the equation $$t_{eq}^{540°} = \int_{time\ spent\ in\ furnace} dt.\exp\left[-\frac{Q}{R}\cdot\left(\frac{1}{T°C.(t)+273}-\frac{1}{540+273}\right)\right]$$

with Q an activation energy of 146 kJ/mol and R=8.314 J/mol

Typically, the continuous annealing line is operated such that the heating rate of the sheet is at least 10° C./s for metal temperature above 400° C., the time above 520° C. is between 5 s and 25 s and the quenching rate is at least 10° C./s, preferably at least 15° C./s for 0.9 to 1.1 mm gauge. Preferred solution heat treatment temperatures are near solidus temperatures typically above 540° C. and below 570° C. The coiling temperature after solution heat treatment is preferably between 50° C. and 90° C. and preferentially between 60° C. and 80° C.

After solution heat treatment and quench the sheet may be aged to a T4 temper and cut and formed to its final shape, painted and bake hardened.

The method of the invention is particularly helpful to make sheets for the automotive industry which combine high tensile yield strength and good formability properties suitable for cold stamping operations, as well as high surface quality and high corrosion resistance with a high productivity.

EXAMPLES

Example 1

In this example several ingots made of alloy AA6005 were cast into rolling ingots with a thickness of 600 mm and transformed. The composition of the alloys is provided in Table 1.

TABLE 1

Composition of the alloys in wt. %

| | Si % | Cu % | Mg % | Mn % | Fe % | Ti % |
|---|---|---|---|---|---|---|
| A | 0.68 | 0.03 | 0.54 | 0.08 | 0.15 | 0.04 |
| B | 0.67 | — | 0.52 | 0.08 | 0.13 | 0.04 |
| C | 0.71 | 0.06 | 0.55 | 0.09 | 0.15 | 0.03 |
| D | 0.70 | 0.04 | 0.54 | 0.08 | 0.21 | 0.04 |

The ingots were homogenized at the temperature of 560° C. during 2 hours. After homogenizing, the ingots were cooled down with a cooling rate at mid-thickness of 300° C./h directly to the hot rolling starting temperature. A thermal differential of less than 40° C. over the entire ingot cooled from the homogenization temperature was obtained. When this thermal differential was reached, hot rolling was started without wait. A device as described in patent application WO2016/012691 was used to cool down the ingots after homogenizing and obtain a thermal differential of less than 40° C. over the entire ingot cooled from its homogenization temperature.

The ingots were hot rolled with the conditions disclosed in Table 2. The hot rolling mill consisted of a reversing mill and a 4 stands tandem mill, the stands being named C3 to C6, so that rolling in C6 is the last stand of hot rolling.

TABLE 2

Hot rolling parameters

| Alloys | Hot rolled strip reference | Entry temperature [° C.] | Coiling temp. tandem exit [° C.] | gauge exit C5 [mm] | gauge exit C6 [mm] | reduction stand C6 [%] |
|---|---|---|---|---|---|---|
| A | A-1 | 452 | 363 | 6.9 | 5.5 | 21% |
| B | B-1 | 447 | 359 | 8.3 | 5.5 | 34% |
| C | C-1 | 429 | 378 | 8.4 | 5.5 | 35% |
| D | D-1 | 414 | 349 | 9.9 | 6.5 | 34% |

The recrystallization rate of the hot rolled strips was measured at three positions along the width. The minimum value obtained is provided in Table 3

TABLE 3

Recrystallization rate after hot rolling

| Hot rolled strip reference | Recrystallization rate |
|---|---|
| A-1 | 35% |
| B-1 | 80% |
| C-1 | 99% |
| D-1 | 100% |

Due do the entry temperature and last stand reduction, hot rolled strip A-1 did not meet the criteria of having at least 50% recrystallization and was not further processed.

The strips were further cold rolled to sheets with a final thickness of 0.95 mm (strip D-1) or 0.9 mm (all the other strips except A-1). The sheets were solution heat treated, such that the equivalent holding time at 540° C. was about 23 s, and quenched in a continuous annealing line.

Roping resistance was measured as follows. A strip of approximately 270 mm (in the transverse direction) by 50 mm (in the rolling direction) was cut from the sheet. A tensile pre-strain of 15% perpendicular to the direction of rolling, i.e. along the length of the strip, was then applied. The strip was then subjected to the action of an abrasive paper of type P800 so as to reveal roping. Roping was then assessed visually and transferred by rating onto a scale from 1 (high roping) to 3 (complete absence of roping: high roping resistance). Examples of roping with 1 to 3 values is provided in FIG. 1.

The roping results are presented in Table 4

TABLE 4

Roping results

| | Roping rating (1 average-3 excellent) |
|---|---|
| B-1 | 1 |
| C-1 | 1 |
| D-1 | 3 |

Roping of samples B-1 and C-1 were less favourable than roping of sample D-1.

The 0.2% tensile yield strength, TYS, and ultimate tensile strength, UTS, of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 5.

TABLE 5

Mechanical properties

| | T4 | | Bake hardened |
|---|---|---|---|
| | TYS LT (MPa) | UTS LT (MPa) | TYS LT (MPa) |
| B-1 | 89 | 193 | 207 |
| C-1 | 85 | 189 | 196 |
| D-1 | 94 | 197 | 200 |

A flat hem procedure in 3 steps is used to assess the material hemming ability. Flat hem acceptability is based on the visual inspection and rating of the hem surface appearance. The test were carried out on T4 sheets having undergone a 2 hours at 100° C. heat treatment.

Each hem specimen includes an outer and an inner sheet of the same initial thickness. The material tested is the outer sheet specimen. A strip of approximately 300×25.2 mm was cut from the test material. A tensile prestrain of 15% was applied to the strip.

A minimum of 3 outer sheet specimens having dimensions of 73 mm by 25 mm were then cut from the prestrained strip. The inner sheet of the hem test specimen had dimensions of 57 mm by 25 mm. The orientation of the hem in relation to the rolling direction of the outer sheet had to be identified. Longitudinal specimens were defined as having the length of the outer sheet parallel to the rolling direction (the bend line is perpendicular to the rolling direction).

Figure 2A:
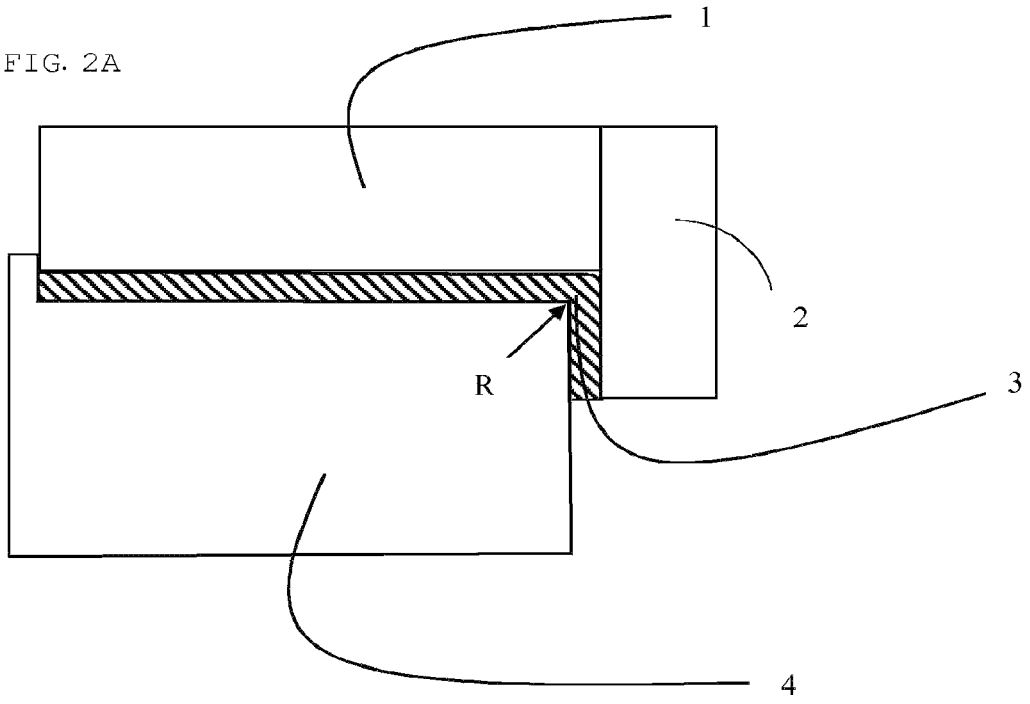
FIG. 2: detailed steps of the hemming test
Figure 2B:
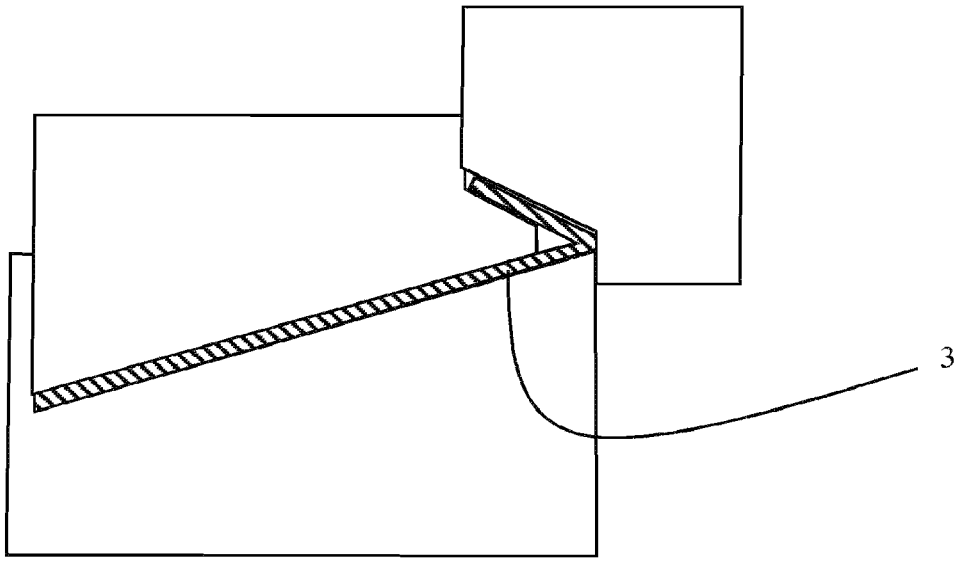
Figure 2C:
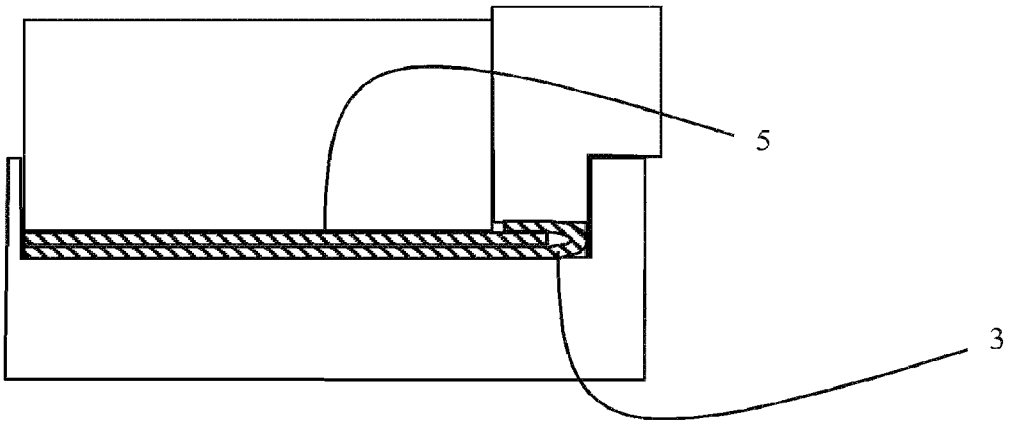
Figure 3:
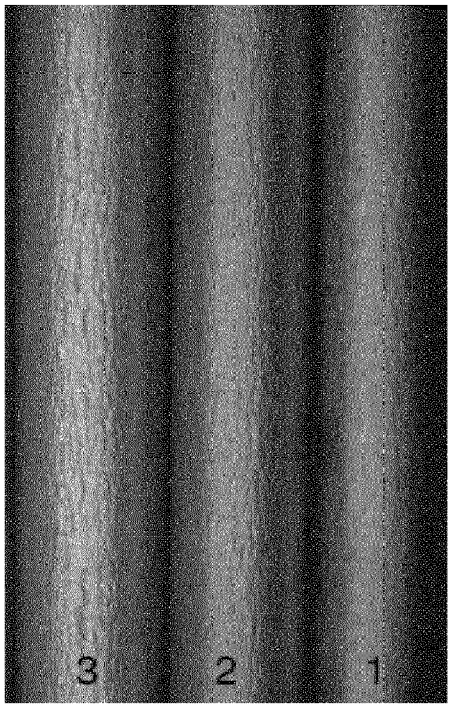
FIG. 3 example of hemming samples with grades 1, 2 and 3-(3 average-1 excellent)

The 3 steps of the flat hem procedure were the following:
(i) first, as described in FIG. 2A the outer sheet specimen (3) was flanged at 90° by a press (1) and a wipe (2) on a flanging die (4) having a length of 60 mm and a flanging radius R=t where t is the initial thickness of the outer sheet.
(ii) in a second step, the outer sheet was flanged at 45°
(iii) in the third step, the inner sheet (5) was introduced and positioned so that the back of the specimens are at the same position in contact with a backup plate, and the outer sheet is flat hemmed on the inner sheet with a pressure of 5 tons. This step is described in FIG. 2C. A maximum value of the test is provided. 1 correspond to an excellent hemming ability and 3 to an average hemming ability, FIG. 3 shows examples of such hemming evaluations.

Results are provided in Table 6

TABLE 6

Hemming evaluation

| | Maximum hemming evaluation (3 average-1 excellent) |
|---|---|
| B-1 | 3 |
| C-1 | 2, 5 |
| D-1 | 1 |

Example 2

In this example an ingot of alloy AA6005 was cast into rolling ingots with a thickness of 600 mm and transformed. The composition of the alloys is provided in Table 7.

TABLE 7

Composition of the alloy in wt. %

| | Si % | Cu % | Mg % | Mn % | Fe % | Ti % |
|---|---|---|---|---|---|---|
| E | 0.70 | 0.04 | 0.56 | 0.09 | 0.18 | 0.04 |

The ingot was homogenized at the temperature of 560° C. for 2 hours. After homogenizing, the ingot was cooled down with a cooling rate at mid-thickness of 300° C./h directly to the hot rolling starting temperature as in example 1.

The ingot was hot rolled with the conditions disclosed in Table 8. The hot rolling conditions in the tandem mill were varied between the tail (E-1) and the head (E-2) of the strip as described in Table 8 so that the effect of coiling temperature could be studied.

TABLE 8

Hot rolling parameters

| Alloys | Hot rolled strip reference | Entry temperature [° C.] | Coiling temp. tandem exit [° C.] | gauge exit C5 [mm] | gauge exit C6 [mm] | reduction stand C6 [%] |
|---|---|---|---|---|---|---|
| E | E-1 | 414 | 351 | 8.3 | 5.5 | 34% |
| E | E-2 | 414 | 340 | 8.3 | 5.5 | 34% |

The recrystallization rate of the hot rolled strips was measured at three positions along the width. The results are provided in Table 9

TABLE 9

Recrystallization rate after hot rolling

| Hot rolled strip reference | Recrystallization rate |
|---|---|
| E-1 | 100% |
| E-2 | 80% |

The strips were further cold rolled to sheets with a final thickness of 0.9 mm.

The sheets were solution heat treated and quenched in a continuous annealing line.

Roping was measured as in example 1

The roping results are presented in Table 10

TABLE 10

Roping results

| | Roping rating (1 average-3 excellent)) |
|---|---|
| E-1 | 3 |
| E-2 | 2 |

Hemming was measured as in example 1. The results are provided in Table 11

TABLE 11

| Hemming results | |
|---|---|
| | Maximum hemming evaluation (3 average-1 excellent) |
| E-1 | 1 |
| E-2 | 1 |

Example 3

In this example two ingots made of alloy AA6005 were cast into rolling ingots with a thickness of 600 mm and transformed. The composition of the alloys is provided in Table 12.

TABLE 12

| Composition of the alloys in wt. % | | | | | | |
|---|---|---|---|---|---|---|
| | Si % | Cu | Mg % | Mn % | Fe % | Ti % |
| F | 0.70 | 0.04 | 0.56 | 0.09 | 0.18 | 0.04 |
| G | 0.66 | | 0.53 | 0.07 | 0.18 | 0.04 |

The ingots were homogenized at the temperature of 560° C. during 2 hours. After homogenizing, ingot F was cooled down with a cooling rate at mid-thickness of 300° C./h directly to the hot rolling starting temperature as in examples 1 and 2.

Ingot G was cooled to room temperature at about 80° C./h and reheated to the hot rolling temperature.

The ingots were hot rolled with the conditions disclosed in Table 13.

TABLE 13

| Hot rolling parameters | | | | | | |
|---|---|---|---|---|---|---|
| Alloys | Hot rolled strip reference | Entry temperature [° C.] | Coiling temp. tandem exit [° C.] | gauge exit C5 [mm] | gauge exit C6 [mm] | reduction stand C6 [%] |
| F | F-1 | 417 | 342 | 8.3 | 5.5 | 34% |
| G | G-1 | 410 | 342 | 8.2 | 5.5 | 33% |

The recrystallization rate of the hot rolled strips was measured at three positions along the width. The results are provided in Table 14

TABLE 14

| Recrystallization rate after hot rolling | |
|---|---|
| Hot rolled strip reference | Recrystallization rate |
| F-1 | 100% |
| G-1 | 100% |

The strips were further cold rolled to sheets with a final thickness of 0.9 mm.

The sheets were solution heat treated and quenched in a continuous annealing line. The speed of the line was adapted to obtain full solutionizing. It was found that sheet F-1 was much easier to solutionize than sheet G-1. In order to reach sufficient mechanical properties sheet F-1 had to be solutionized at 45 m/min such the equivalent holding time at 540° C. was about 22 s whereas sheet G-1 had to be solutionized at 55 m/min with the same furnace conditions such that the equivalent holding time at 540° C. was about 38 s.

Roping was measured as in example 1.

The roping results are presented in Table 15

TABLE 15

| Roping results | |
|---|---|
| | Roping rating (1 average-3 excellent)) |
| F-1 | 2 |
| G-1 | 3 |

The yield strength of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 16

TABLE 16

| Mechanical properties | | | |
|---|---|---|---|
| | T4 | | Bake hardened |
| | TYS LT (MPa) | UTS LT (MPa) | TYS LT (MPa) |
| F-1 | 92 | 197 | 206 |
| G-1 | 96 | 202 | 212 |

Hemming was measured as in example 1. Hemming results are provided in Table 17.

TABLE 17

| Hemming evaluation | |
|---|---|
| | Maximum hemming evaluation (3 average-1 excellent) |
| F-1 | 2 |
| G-1 | 1 |

Example 4

In this example several ingots made of alloy AA6016 were cast into rolling ingots with a thickness of 600 mm and transformed. The composition of the alloys is provided in Table 18.

TABLE 18

| Composition of the alloys in wt. % | | | | | | |
|---|---|---|---|---|---|---|
| | Si % | Cu % | Mg % | Mn % | Fe % | Ti % |
| H | 0.91 | — | 0.41 | 0.17 | 0.24 | 0.02 |
| I | 0.92 | — | 0.42 | 0.17 | 0.24 | 0.02 |

The ingots were homogenized at the temperature of 560° C. during 2 hours. After homogenizing, the ingots were cooled down with a cooling rate of at mid-thickness 150° C./h directly to the hot rolling starting temperature as in example 1. The ingots were hot rolled with the conditions disclosed in Table 19.

TABLE 19

| Hot rolling parameters | | | | | | |
|---|---|---|---|---|---|---|
| Alloys | Hot rolled strip reference | Entry temperature [° C.] | Coiling temp. tandem exit [° C.] | gauge exit C5 [mm] | gauge exit C6 [mm] | reduction stand C6 [%] |
| H | H-1 | 429 | 355 | 7.5 | 4.8 | 36% |
| I | I-1 | 418 | 351 | 7.5 | 4.8 | 36% |

The recrystallization rate of the hot rolled strips was measured at three positions along the width. The results are provided in Table 20

TABLE 20

| Recrystallization rate after hot rolling | |
|---|---|
| Hot rolled strip reference | Recrystallization rate |
| H-1<br>I-1 | 50% |

The strips were further cold rolled to sheets with a final thickness of 0.8 mm. The sheets were solution heat treated and quenched in a continuous annealing line. The equivalent time at 540° C. was about 16 s.

Roping was measured as in example 1

The roping results are presented in Table 21.

TABLE 21

| Roping results | |
|---|---|
| | Roping rating (1 average-3 excellent)) |
| H-1 | 1 |
| I-1 | 3 |

The yield strength of the T4 (after 6 days of natural ageing) and bake hardened sheets (2% stretching and 20 min at 185° C.) from those T4 aged sheets were determined in the transverse direction using methods known to one of ordinary skill in the art. The tensile tests were performed according to ISO/DIS 6892-1. The results are provided in Table 22

TABLE 22

| Mechanical properties | | | |
|---|---|---|---|
| | T4 | | Bake hardened |
| | TYS LT (MPa) | UTS LT (MPa) | TYS LT (MPa) |
| H-1 | 88 | 202 | 195 |
| I-1 | 98 | 212 | 213 |

Example 5

In this example, several rolled sheets were produced while adjusting the production conditions. The mechanical properties of the produced aluminum alloy rolled sheets were measured and evaluated, and the mechanical characteristics (tensile strength and 0.2% proof stress), bending workability and roping resistance were subjected to an evaluation test. First, two aluminum alloys having a composition shown in Table 23 were cast by using a DC casting method.

TABLE 23

| Composition of the alloy in wt. % | | | | | | | | |
|---|---|---|---|---|---|---|---|---|
| | Si % | Cu % | Mg % | Mn % | Fe % | Cr % | Zn % | Ti % |
| J | 0.74 | 0.68 | 0.68 | 0.12 | 0.16 | 0.02 | 0.03 | 0.02 |
| K | 1.02 | 0.02 | 0.51 | 0.07 | 0.18 | — | 0.01 | 0.02 |

The resulting ingots (crosswise section size: 500 mm thick, 1000 mm wide) were homogenized at 550° C. for 6 hours, then cooled directly to the hot rolling temperature and hot rolled. In example J-1 and K-1 and K-2, the cooling speed of the ingot was 1800° C./h whereas in example J-2 and J-3 the cooling speed of the ingot was less than 140° C./h. Here, the cooling speed of the ingot was measured by temperature measurement at ¼ of the ingot. The cooling speed, heat history and hot rolling temperature of the present examples are shown in Table 24. A wait at hot rolling temperature is also mentioned.

TABLE 24

| Processing conditions and ingot characterization | | | | | | | | |
|---|---|---|---|---|---|---|---|---|
| | Cooling rate after homog. | Conditions for holding at hot rolling temperature | | Ingot precipitates before hot rolling | | Hot rolling coiling temperature | Recrystal-lization rate | Cold rolling ratio |
| Condition | (° C./h) | Temp. (° C./h) | Wait (h) | Aver. size (μm) | Number (/100 μm$^2$) | (° C.) | | |
| J-1 | 1800 | 440 | 4.0 | 1.3 | 402 | 339 | 100 | 70 |
| J-2 | 90 | 400 | 1.0 | 1.2 | 532 | 337 | 100 | 80 |
| J-3 | 30 | 370 | 1.0 | 1.0 | 746 | 351 | 100 | 70 |
| K-1 | 1800 | 400 | 0.12 | 0.5 | 493 | 334 | 88 | 80 |
| K-2 | 1800 | 400 | 0.2 | 0.6 | 402 | 336 | 100 | 80 |

After hot rolling, cold rolling and a solution treatment were carried out. The rolling ratio of the cold rolling is shown in Table 24. A 5 hours preliminary aging at 80° C. was performed straightaway. A JIS5 specimen was cut out in a direction parallel to the rolling direction from each of the aluminum alloy rolled sheets produced in the present examples. Ultimate tensile strength (UTS) and 0.2% tensile yield strength (TYS) were measured by tensile testing.

The distribution of Mg—Si base particles in the aluminum alloy ingot before hot rolling was also studied in the present examples. For this study, a fragment sample was cut at a location 500 mm from the edge of the ingot after casting of the above test material, at ¼ of the thickness at the ingot width center. Samples reproducing heat histories (heat history from homogenization to holding at hot rolling temperature before hot rolling) equivalent to those of the examples and comparative examples of Table 24 were made in the laboratory, the surface thereof was mirror-polished then imaged with FE-SEM and image analysis was performed. In the evaluation of this material structure, coarse precipitation particles with a particle diameter of 0.4 μm to 4 μm among the crystal particles that can be observed on the SEM image were extracted and the mean particle size thereof was calculated. In addition, the number of precipitation particles with a particle diameter of 0.04 μm to 0.4 μm among the crystal particles that can be observed on the SEM image was quantified. The results are shown in Table 24. The ingot of tests J-1 and K-1 and K-2 obtained with a method according to the invention exhibited a smaller average precipitate size and/or a smaller number of coarse precipitates than the reference ingot J-2 and J-3 and nevertheless 100% recrystallization was obtained after hot rolling for J-1 and K-2. For sample K-1 the combination of cooling rate and wait before hot rolling did not enable full recrystallization.

Additionally, tensile test results, roping and hemming properties was checked as in previous examples. The results are provided in Table 25.

TABLE 25

| Production process | Tensile test results TYS L (MPa) | UTS L (MPa) | UTS-TYS (MPa) | Roping evaluation After 10% stretch | After 15% stretch | Hemming test rating |
|---|---|---|---|---|---|---|
| J-1 | 110 | 241 | 131 | 3 | 3 | 1 |
| J-2 | 115 | 243 | 128 | 3 | 3 | 2 |
| J-3 | 112 | 239 | 127 | 3 | 3 | 2 |
| K-1 | 112 | 224 | 112 | 2 | 2 | 1 |
| K-2 | 111 | 223 | 112 | 3 | 2 | 1 |

The invention claimed is:

1. A method for producing a 6xxx series aluminium sheet comprising homogenizing an ingot made from a 6XXX series aluminum alloy comprising 0.3-1.5 wt. % of Si, 0.3-1.5 wt. % of Mg and 1.5 wt. % or less of Cu, Mn 0.03-0.5 wt. % and/or Cr 0.01-0.4 wt. %, Fe 0.03 to 0.4 wt. %, Ti up to 0.1 wt %, rest aluminium and unavoidable impurities up to 0.05 wt. % each and 0.15 wt. % total, wherein the aluminum alloy ingot comprises at least 250 mm in thickness, from 1000 to 2000 mm in width, and from 2000 to 8000 mm in length; a top surface, a bottom surface, and four side surfaces, wherein the top and bottom surfaces have a larger surface area than the side surfaces; and a head and a foot corresponding to extremities in a longitudinal direction, cooling the homogenized ingot with a cooling rate at mid-thickness and/or at quarter thickness in a range from 150° C./h to 2000° C./h directly to a hot rolling starting temperature, wherein a thermal differential of less than 40° C. over the entire ingot, which is cooled from the homogenization temperature, is obtained when hot rolling is started, hot rolling the ingot to a hot rolling final thickness and coiling at the hot rolling final thickness with such conditions that at least 50% recrystallization is obtained, wherein the hot rolling starting temperature is between 350° C. and 450° C. and a hot rolling exit temperature is at least 310° C. and wherein the thickness reduction during a last hot rolling pass is at least 25%, cold rolling to obtain a cold rolled sheet.

2. A method according to claim 1 wherein the cold rolling reduction is at least 65%.

3. A method according to claim 1 wherein the cold rolled sheet is further solution heat treated and quenched in a continuous annealing line.

4. A method according to claim 3 wherein the continuous annealing line is operated in such a way that the equivalent holding time at 540° C., $t_{eq}^{540°}$, is less than 35 sec, the equivalent holding time being calculated according to the equation $$t_{eq}^{540°} = \int_{time\ spent\ in\ furnace} dt.\exp\left[-\frac{Q}{R}\cdot\left(\frac{1}{T^{°C.}(t)+273}-\frac{1}{540+273}\right)\right]$$

with Q an activation energy of 146 kJ/mol and R=8.314 J/mol.

5. A method according to claim 3 wherein after solution heat treatment and quench the sheet is aged to a T4 temper, cut and formed to final shape, painted and bake hardened.

6. A method according to claim 1 wherein the cooling is carried out in at least two phases: a first spraying phase in which the ingot is cooled in a chamber comprising ramps of nozzles for spraying cooling liquid or spray under pressure, divided into upper and lower parts of said chamber, so as to spray the top and bottom surfaces of said ingot and a complementary phase of thermal equalization in still air, in a tunnel with interior reflective walls, lasting from 2 to 30 minutes depending on the ingot format and the cooling.

7. A method according to claim 6 wherein the spraying and thermal equalization phases are repeated, and the ingot has a thickness of at least 400 mm and a cooling of more than 80° C.

8. A method according to claim 6, wherein the cooling liquid, including that in a spray, is water, and optionally deionized water.

9. A method according to claim 1, wherein the head and the foot of the ingot are less cooled than the rest of the ingot, so as to maintain a hot head and foot.

10. A method according to claim 6, wherein cooling of the head and the foot is modulated by turning the ramps of nozzles on or off.

11. A method according to claim 9, wherein the cooling of the head and the foot is modulated by the presence of screens.

12. A method according to claim 6, wherein the spraying phase and not the thermal equalization phase is repeated, and the head and the foot of the ingot are cooled differently from the rest of the ingot in at least one of the spray phases.

13. A method according to claim 6, wherein the longitudinal thermal uniformity of the ingot is improved by relative movement of the ingot in relation to the ramps of nozzles: the ingot passes or moves with a reciprocating movement facing the ramps of nozzles or vice versa.

14. A method according to claim 13, wherein the ingot moves horizontally in the spray phase and its speed is greater than, or equal to 20 mm/s, or 1.2 m/min.

15. A method according to claim 6, wherein transverse thermal uniformity of the ingot is ensured by modulating spraying in the ingot width by switching the nozzles or spray nozzles on or off, or screening said spraying.

16. The method according to claim 4 wherein the equivalent holding time at 540° C., $t_{eq}^{540°}$, is less than 25 seconds.

17. A method according to claim 1, wherein the hot rolling exit temperature is at least 330° C.

18. A method according to claim 1, wherein the hot rolling exit temperature is at least 337° C.

19. A method according to claim 1, wherein no annealing and/or solution heat treatment after hot rolling or during cold rolling is carried out.

* * * * *